United States Patent [19]

Armitage, Jr. et al.

[11] 4,255,042

[45] Mar. 10, 1981

[54] LIGHT PIPE FOR ACCURATE ERASURE OF PHOTOCONDUCTOR CHARGE

[75] Inventors: John D. Armitage, Jr., Longmont; John A. Barkley; Ross B. Hooker, III, both of Boulder; James R. Walker, Longmont, all of Colo.

[73] Assignee: International Business Machines Corporation, Armonk, N.Y.

[21] Appl. No.: 23,989

[22] Filed: Mar. 26, 1979

[51] Int. Cl.[3] ..... G03G 15/00

[52] U.S. Cl. ..... 355/3 R; 355/1; 355/70; 362/27; 362/31; 362/800

[58] Field of Search ..... 355/1, 3 R, 3 CH, 7, 355/11, 70; 362/27, 31, 32, 800

[56] References Cited

U.S. PATENT DOCUMENTS

| | | | |
|---|---|---|---|
| 3,330,190 | 7/1967 | Taillie | 355/1 X |
| 3,803,409 | 4/1974 | Prochazka | 250/227 |
| 3,827,799 | 8/1974 | Koizumi | 355/3 R |
| 3,912,387 | 10/1975 | Brooke | 355/3 R |
| 3,932,761 | 1/1976 | Ramsey | 250/552 |
| 3,948,582 | 4/1976 | Martin | 350/96 C |
| 3,967,893 | 7/1976 | Majewicz | 355/4 |
| 3,968,564 | 7/1976 | Springthorpe | 29/580 |
| 4,008,954 | 2/1977 | Ogawa et al. | 355/1 |
| 4,035,070 | 7/1977 | Hammond | 355/3 R |
| 4,110,026 | 8/1978 | Farley et al. | 362/31 X |
| 4,133,609 | 1/1979 | Arai | 355/7 X |

*Primary Examiner*—R. L. Moses

*Attorney, Agent, or Firm*—Charles E. Rohrer

[57] ABSTRACT

Erase apparatus for use in an electrophotographic copier machine where an array of light-emitting diodes (LEDs) are placed adjacent one end of a light channel with the other end adjacent a moving photoreceptive surface. The channel allows light rays to pass freely from LED to LED but contains the rays in a direction parallel to the direction of photoreceptor movement. The channel may be comprised of sides with reflective surfaces normal to the photoreceptive surface or may be a solid plastic sheet through which the rays pass. In the latter embodiment, rays are internally reflected from the surfaces of the plastic sheet.

4 Claims, 4 Drawing Figures

LIGHT PIPE FOR ACCURATE ERASURE OF PHOTOCONDUCTOR CHARGE

This invention relates to document copier machines of the electrophotographic type and more particularly to the erasure of charge between images and on the edges of images produced on the photoconductive surfaces of these machines.

BACKGROUND OF THE INVENTION

In the electrophotographic process used in document copier machines of the transfer type, a photoconductive material is placed around a rotating drum or arranged as a belt to be driven by a system of rollers. The moving photoconductive material is passed under a charge-generating station to place a relatively uniform electrostatic charge, usually several hundred volts, across the entirety of the photoconductive surface. Next the photoconductor is moved to an imaging station where it receives light rays reflected from the document to be copied. Since white areas of the original document reflect large amounts of light, the photoconductive material will be discharged to relatively low voltage levels in white areas while the dark areas will continue to contain high voltage levels even after exposure. In that manner, the photoconductive material is caused to bear a charge pattern which corresponds to the printing, shading, etc. present on the original document.

After receiving the image, the photoconductor rotates to a developing station where a developing material, called toner, is placed on the image. This material may be in the form of a black powder which carries a triboelectric charge opposite in polarity to the charge pattern on the photoconductor. Because of the attraction of the oppositely-charged toner, it adheres to the surface of the photoconductor in proportions related to the shading of the original. Thus, black printing should receive heavy toner deposits, white background areas should receive none, and gray or otherwise shaded portions of the original should receive intermediate amounts. The developed image is then moved to a transfer station where a copy-receiving material, usually paper, is juxtaposed to the developed image on the photoconductor. A charge is then placed on the backside of the copy paper so that when the paper is stripped from the photoconductor, the toner material is held on the paper and removed from the photoconductor. The remaining process steps call for permanently bonding the toner material to the copy paper and cleaning any residual toner left upon the photoconductive material so that it can be reused for a subsequent copy production.

In the cleaning step, it is customary to pass the photoconductor under a preclean charge-generating station to neutralize the charged areas and pass the photoconductor under an erase lamp to discharge any remaining charge. In that manner, the residual toner is no longer held by electrostatic attraction to the photoconductor surface and thus it can be easily removed at a cleaning station.

In order to avoid overburdening the cleaning station, it is customary to remove all charge present on the photoconductive surface outside of the image area prior to the development step. This is usually done by using an interimage erase lamp to discharge photoconductive material between the trailing edge of one image and the leading edge of the next. Also, edge erase lamps are used to erase charge along the edges of the photoconductor outside of the image area. For example, if the original document is 215.9×279.4 mm (8.5×11 inches) in size, and if a full-sized reproduction is desired, the dimensions of the image on the photoconductor will also be 215.9×279.4 mm (8.5×11 inches).

Many copy machines have the capability of copying various size documents and reproducing them to full size. It is not uncommon for machines to be capable of copying 203.2×254-mm (8×10-inch) originals, 215.9×279.4-mm (8.5×11-inch) originals, 215.9×330.2-mm (8.5×13-inch) originals and 215.9×355.6-mm (8.5×14-inch) originals. Because of the different sized originals the interimage and edge erase mechanisms must be controlled to erase only that part of the photoconductor which is not being used to reproduce an image for a particular size paper.

Conventionally, the interimage erase mechanism has been either an incandescent or fluorescent lamp(s) whose full energization is controlled to erase only the correct area on the photoconductor. Additionally, the lamps are covered by shields which direct the illumination to the photoconductor in order to obtain sharp edge delineation of the erased charge on the photoconductor. For edge erase mechanisms, typically incandescent lamps have been used where one lamp may erase to the 215.9-mm (8.5-inch) size, for example, and a second lamp to the 203.2-mm (8-inch) 8-inch size. For both paper sizes, the lamps will be shielded so that sharp cutoff is obtained.

While there has been some experimentation with the use of light-emitting diodes (LEDs), the prior art approach has been too expensive for use in commercial machines. Light-emitting diodes each produce a relatively small quantity of light as compared to other types of incandescent lamps. Consequently, they must be situated in an environment where high efficiency light transmitting apparatus is used. As a result, LEDs have been used with fiber optics to transmit light to the photoconductor of xerographic machines and because of the cost of fiber optics the system has not been practical. As a consequence, it is an object of this invention to provide innovative light-transmitting pipes for channeling light from an LED to a xerographic surface in an economical but efficient manner such that LEDs may be used with photoconductive surfaces in a document copying machine to perform the interimage and edge erase functions.

When a succession of discrete light sources are used, such as an LED array, it is desirable to spread the light from LED to LED so that there will be no gaps in the erasure of the photoconductor. On the other hand, it is necessary to control the spreading of light in a second dimension so as to obtain sharp edge delineation of the erased charge. As a consequence, it is an object of this invention to provide a light-channeling mechanism which propagates light in one dimension while cutting it off in a second dimension.

SUMMARY OF THE INVENTION

This invention provides a light channel, one end of which is juxtaposed to an array of discrete light-emitting sources, such as light-emitting diodes, for channeling light produced by the discrete sources to a photoconductive surface located at the opposite end of the channel. The sides of the channel normal to the photoconductive surface provide boundaries to the channel beyond which light is not transmitted. In that manner, the footprint of light on the photoconductive surface is accurately maintained with sharp edges while at the same time allowing full propagation of light between the sides of the channel.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION

Figure 1:
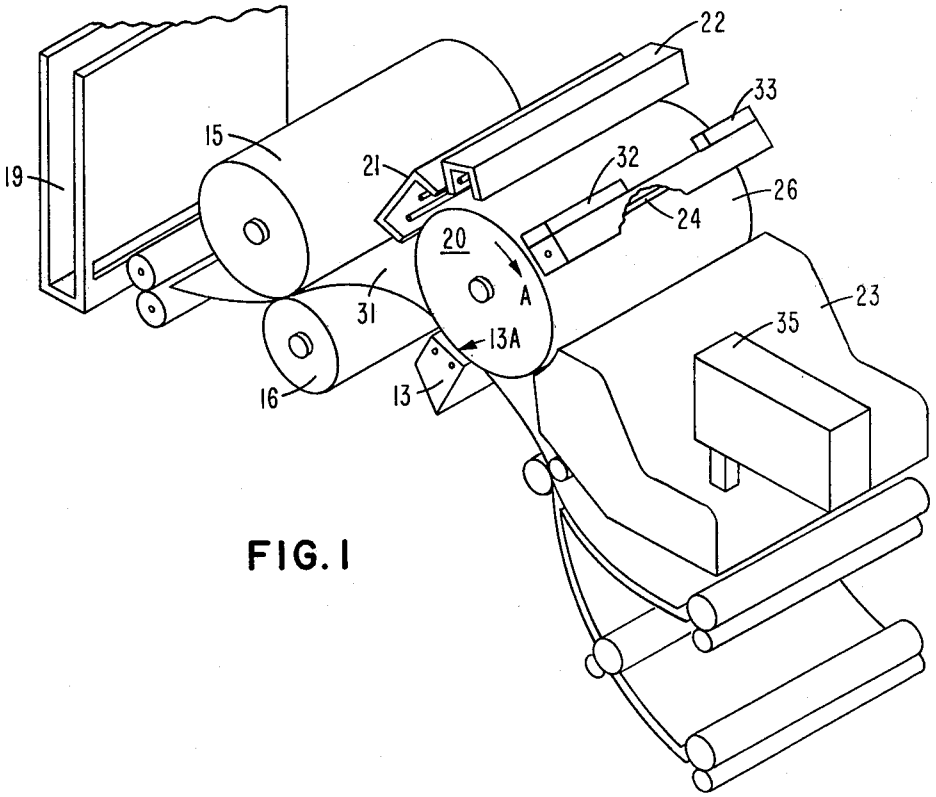
FIG. 1 is a view in perspective of the paper path of a typical electrophotographic copier machine.

FIG. 1 illustrates the paper path of an electrophotographic machine of the transfer type. The particular configuration illustrated is a two-cycle machine in which developing and cleaning is performed at the same station. On the first cycle of operation of such a machine, photoconductor located on photoconductive drum 20 rotates under the charging corona 21 which places a uniform charge over the entire photoconductor. The material then rotates under preclean corona 22 which is deenergized on the first cycle and continues to erase lamps 24, 32 and 33. The function of the erase lamps at this point in the process is to discharge the areas of the photoconductor that will not receive an image of the document to be copied. Consequently, the lamp 24 is energized between image areas and lamps 32 and 33 are energized to erase along the edges of the photoconductive surface so that the charge placed on the photoconductor by the charging station 21 will continue to exist only in, for example, a 215.9×279.4-mm (8.5×11-inch) area of the photoconductor. That charged area then rotates to the exposure station 26 at which an image of the document to be copied is placed on the charged portion of the photoconductor. Next the photoconductor rotates to the developing mechanism 23 at which toner is placed on the image and then to the transfer station 13A at which the image is transferred to copy paper 31 under the influence of transfer corona 13.

The photoconductor continues to advance from the transfer station to the charging corona 21 which is deenergized for the second cycle and from there to the preclean corona 22 which is now energized in order to neutralize remaining charge on the photoconductor. The photoconductor then rotates to the erase lamp 24 which is energized to completely discharge any charge that may remain. The photoconductor rotates past imaging station 26 at which no image is put on the photoconductor on this cycle, to the developing mechanism 23 which now acts as a cleaning mechanism to clean away any toner which was not transferred on the first cycle. The photoconductor continues to rotate past a deenergized transfer station 13 to now energized charging corona 21 at which point the second cycle has been completed and the first cycle begins again.

Meanwhile, the copy sheet 31 upon receiving an image of the original, advances from the transfer station to a fusing station illustrated by rolls 15 and 16 and from there into an exit pocket 19 in which the finished copies are retained until removed by the operator. A replenishing mechanism 35 is shown to keep the developer 23 charged to the proper level with toner.

As previously mentioned, in prior art electrophotographic machines, the erase lamp 24 is typically a fluorescent bulb whose light is directed to the photoconductive surface by a shield 24 which contains an aperture so that sharp delineation of the light is obtained. Erase lamps at either edge of the photoconductor 32 and 33 are shown and also contain lamps, typically incandescent lamps, which provide light through an aperture to the photoconductive surface in order to define the edges of the charged image area. In the use of the invention described herein, interimage lamp 24 and edge erase lamps 32 and 33 are replaced by a light-emitting diode array with the inventive light channels now to be described.

Figure 2:
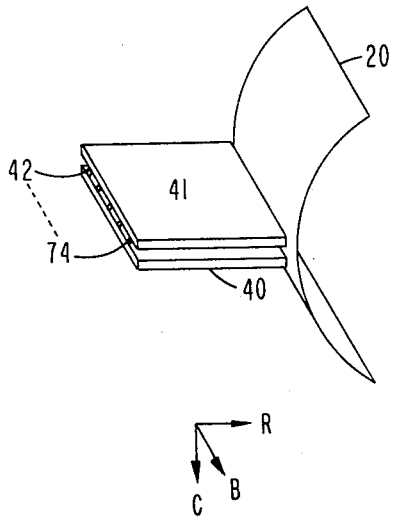
FIG. 2 is a diagrammatic representation of the LED array and the channel of this invention.
Figure 3:
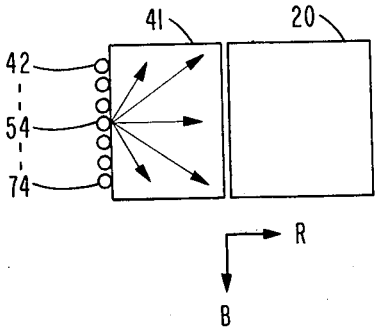
FIG. 3 illustrates the spreading of light rays from LED to LED.
Figure 4:
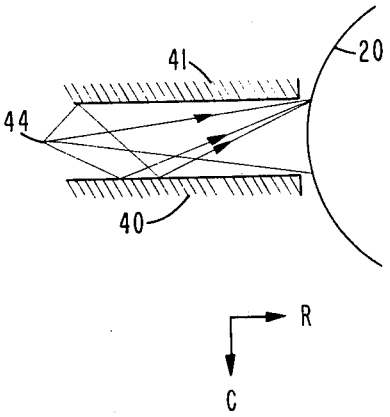
FIG. 4 illustrates the constraints on light rays in a direction parallel to the movement of the drum surface.

FIGS. 2, 3 and 4 illustrate the principles of the invention. FIG. 2 shows an electrophotographic drum 20 with plates 40 and 41 located adjacent thereto. The facing surfaces of these plates are mirrored and an array of LEDs 42–74 is placed at one end of the mirrors to shine into the space between them. FIG. 3 shows a top view of the arrangement of FIG. 2 with LED 54 shown emitting light rays toward a drum 20. FIG. 3 illustrates that the light rays from LED 54 are allowed to propagate unimpeded in a direction parallel to the axis of drum 20, i.e., the rays propagate in an unimpeded fashion in direction B. While the rays from LED 54 are shown in FIG. 3, each of the LEDs emit in a similar pattern and thus light rays from each of the LEDs fill in the gaps from LED to LED so that a uniform intensity of light appears across the surface of the drum in the direction B.

FIG. 4, on the other hand, illustrates that the mirrored surfaces of plates 41 and 42 cause the light rays to be captured in direction C. Thus, as the rays move in direction R from the LED array toward the drum surface, the light rays are allowed to propagate in direction B but are contained in direction C. In that manner, a sharp footprint in direction C is provided on the drum surface so that when the LEDs are extinguished a very sharp edge to the exposed area of the photoconductor is achieved. On the other hand, by allowing light to propagate in direction B, gaps between LEDs are filled in as previously stated.

The flat mirrors shown in FIGS. 2, 3 and 4 may be separated by, for example, 5.08 mm (0.2 inches), with the LED array located about 25.4 mm (1 inch) from the surface of the drum 20. While not shown in FIGS. 2, 3 and 4, thin separator plates may be placed normal to the mirrors and normal to the drum axis in order to divide the total length of the erase into the required number of zones to allow sequential or zone erase. This feature will be developed further with respect to the preferred embodiment.

Figure 5:
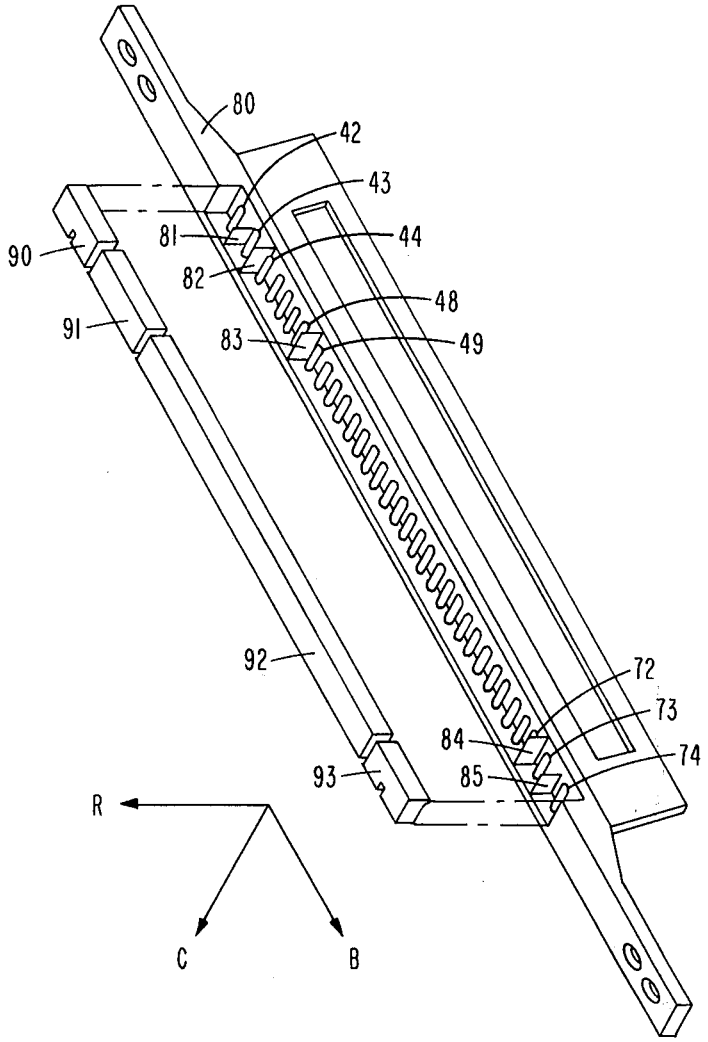
FIG. 5 shows another embodiment of this invention.

The preferred embodiment is shown in FIG. 5 where an LED array 42–74 is shown mounted on bracket 80. Separator plates 81–85 are shown dividing the LED array into segments, while the light channel is shown segmented into four pieces, 90, 91, 92, and 93. In this preferred embodiment of the invention instead of using mirrored plates to channel the light toward the drum surface, a thin rectangular sheet of plastic or glass with polished surfaces is used. The LED array is positioned along one edge of the rectangular sheets 90–93, as shown in FIG. 5, and emits light into the sheets. This light is internally reflected at the surfaces of the sheet and propagates down the sheet toward the photoconductive drum. Since internal reflection is basically lossless, the transmission efficiency is very high and limited only by a small amount attributed to the absorption of the material. Light rays inside one of the plastic sheets, such as for example, sheet 92, are allowed to freely propagate in direction B, while the rays are restricted by the surfaces of the plastic sheet in direction C. In that manner the light is propagated from the light source in direction R to the surface of the drum but are contained in direction C, thus providing a sharp edge to the footprint of light. Simultaneously, the light rays are allowed to propagate in direction B in order to provide a uniform intensity along the length of the photoconductor to fill in the gaps from LED to LED. By providing the sheets in segments separated by the separators 81–85, a segmented array is provided such that individual segments of LEDs can be energized separately from other segments of LEDs in order to erase for specific functions. Separators 81–85 may be opaque fins or may be air gaps between channels. For example, LEDs 42 and 43, 74 and 75, may be energized on a continual basis in order to provide an edge erase function suitable for the widest paper to be placed on the drum, e.g., 215.9-mm (8.5-inch) paper. If producing 203.2-mm (8-inch) copy, the edge erase function could be extended by energizing LEDs 44–48. LEDs 49–73 would be intermittently turned on and off in order to provide an interimage erase for the 203.2-mm (8-inch) paper, while LEDs 44–73 would be intermittently turned on and off for interimage erase on 215.9-mm (8.5-inch) paper. Thus, this one light array has incorporated within it the capability of both edge erase and interimage erase, in contrast to the separate edge and interimage lamps used in prior art devices.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. An electrophotographic copier machine wherein a photoreceptive surface is charged to receive an image within an image area of specified size, comprising:

means upon which said photoreceptive surface is mounted for moving said surface in a continuous path;

charge-generating means located along said path for producing a relatively uniform electrostatic charge on said surface;

exposing means for directing light rays from an object to said surface to produce a variable discharge of said image area such that said image area is caused to bear an electrostatic image of said object;

developing means to develop said electrostatic image by depositing developing material on said surface;

transfer means to transfer the developed image to a copy-receiving medium;

cleaning means to clean said surface of excess developing material to prepare said surface for producing a subsequent copy;

first charge erase means located along said path between said charge-generating means and said developing means for removing charge on said surface between image areas, said first means comprising an array of light-emitting diodes;

second charge erase means also located along said path between said charge-generating means and said developing means for removing charge along the edges of said surface outside said image area, said second means comprising an array of light-emitting diodes; and light channel means comprising a plurality of sheets of transparent material located between said array of light-emitting diodes (LED) and said surface, for allowing light rays to propagate freely in a first direction parallel to said surface from LED to LED within each one of said plurality of sheets, said sheets separated from each other by an air space to divide said array into groups of LEDs, said sheets having sides essentially normal to said surface so as to contain said light rays between said sides in a second direction normal to said first direction.

2. The machine of claim 1 wherein said groups of LEDs are individually controlled.

3. In an electrophotographic machine of the transfer type wherein erase mechanisms are included for shaping the charged image area of a moving photoreceptive surface to the dimensions of the image, the improvements comprising:

an array of LEDs for producing light rays to erase charge outside of said image area, said array located adjacent to said surface across the width thereof;

a light channel means located between said array and said surface to freely propagate said light rays in a first direction parallel to said surface from LED to LED while containing said light rays in a second direction normal to said first direction and said light channel means comprising a plurality of sheets of transparent material located between said array of LEDs and said surface, each one of said sheets separated from the other by an air gap to divide said array into groups of LEDs.

4. The machine of claim 3 wherein said groups of LEDs are individually controlled.

* * * * *